US008387217B1

(12) United States Patent
Hinds et al.

(10) Patent No.: US 8,387,217 B1
(45) Date of Patent: Mar. 5, 2013

(54) STRAP ATTACHMENT DEVICE

(75) Inventors: Robert S. Hinds, Madison, WI (US); Glenn Polinsky, Waunakee, WI (US); Ray Rollins, Verona, WI (US); John Stephenson, Madison, WI (US)

(73) Assignee: Robert S. Hinds, Madison, WI (US)

( * ) Notice: Subject to any disclaimer, the term of this patent is extended or adjusted under 35 U.S.C. 154(b) by 266 days.

(21) Appl. No.: 12/820,168

(22) Filed: Jun. 22, 2010

Related U.S. Application Data

(60) Provisional application No. 61/256,360, filed on Oct. 30, 2009.

(51) Int. Cl.
*F16B 45/00* (2006.01)

(52) U.S. Cl. ..... 24/265 H; 24/134 R; 24/170; 482/91

(58) Field of Classification Search ..... 24/318, 24/321, 319, 343, 344, 345, 349, 265 H, 68 CD, 24/69 CT, 71 ST, 71 TD, 191, 192, 193; 482/910, 482/49, 92, 96, 40, 129, 121, 134; 16/422; 254/217, 223, 365, 391, 411
See application file for complete search history.

(56) References Cited

U.S. PATENT DOCUMENTS

| | | | | | |
|---|---|---|---|---|---|
| 479,026 | A | * | 7/1892 | Smeal | 24/165 |
| 631,486 | A | | 8/1899 | Fischer | |
| 1,565,392 | A | * | 12/1925 | Powers | 24/265 H |
| 2,270,271 | A | * | 1/1942 | Coffing | 254/223 |
| 2,442,266 | A | | 5/1948 | Davis | |
| 2,511,579 | A | | 6/1950 | George | |
| D171,045 | S | | 12/1953 | Noe | |
| 2,942,315 | A | * | 6/1960 | Johnson | 24/134 R |
| D188,897 | S | | 9/1960 | Prete, Jr. | |
| 2,998,626 | A | | 9/1961 | Prete, Jr. | |
| 3,020,612 | A | | 2/1962 | Meeker | |
| 3,165,805 | A | | 1/1965 | Lower | |
| 3,173,539 | A | * | 3/1965 | Looker | 206/597 |
| 3,253,309 | A | * | 5/1966 | Baresch | 24/170 |
| 3,608,158 | A | | 9/1971 | Bengtsson | |
| 3,678,542 | A | | 7/1972 | Prete, Jr. | |
| 3,852,855 | A | | 12/1974 | Bengtsson | |
| 3,863,303 | A | | 2/1975 | Armstrong et al. | |
| 4,257,644 | A | * | 3/1981 | Stephens | 296/65.04 |
| D274,861 | S | | 7/1984 | Lindblad | |
| 4,507,829 | A | * | 4/1985 | Looker | 24/68 CD |
| 4,567,628 | A | | 2/1986 | Prete, Jr. et al. | |
| 4,918,790 | A | | 4/1990 | Cirket et al. | |
| 4,942,647 | A | | 7/1990 | Wallner | |
| D333,640 | S | | 3/1993 | Keller | |
| 5,301,911 | A | | 4/1994 | Beauchemin | |
| 5,345,947 | A | | 9/1994 | Fisher | |
| 5,469,583 | A | | 11/1995 | Akeley et al. | |

(Continued)

*Primary Examiner* — Robert J Sandy
*Assistant Examiner* — Rowland D Do
(74) *Attorney, Agent, or Firm* — Craig A. Fieschko, Esq.; DeWitt Ross & Stevens S.C.

(57) ABSTRACT

A strap attachment device includes a main body with a lower body end that has an opening suited for a strap. Based on its position, a cam lever at the opening of the lower body end holds or releases the strap, permitting adjustment of the length of the strap that enters the opening. Extending upward from the lower body end is an upper body end that is curved into a hook or any other shape appropriate for connection to an object. A flexible or translatable gate may extend from the main body so as to prevent the upper body end from inadvertently becoming detached from the object. Slip-resistance on the upper body end resists slippage between the upper body end and the object during side-to-side movements. Ends of the strap may include a loop or handle or connect to other devices.

2 Claims, 5 Drawing Sheets

U.S. PATENT DOCUMENTS

| | | | | |
|---|---|---|---|---|
| 5,695,101 | A | 12/1997 | Frietze | |
| 5,893,199 | A | 4/1999 | Anscher | |
| 5,920,963 | A * | 7/1999 | Chou | 24/170 |
| 6,267,711 | B1 | 7/2001 | Hinds | |
| 6,360,747 | B1 | 3/2002 | Velarde et al. | |
| 6,371,346 | B1 | 4/2002 | Sharma | |
| 6,665,913 | B2 * | 12/2003 | Kosh et al. | 24/193 |
| 6,921,354 | B1 * | 7/2005 | Shifferaw | 482/91 |
| 6,941,620 | B1 | 9/2005 | Hinds | |
| 8,007,413 | B1 * | 8/2011 | Wu | 482/91 |
| 2001/0045548 | A1 | 11/2001 | Landy | |
| 2003/0041420 | A1 * | 3/2003 | Kosh et al. | 24/193 |
| 2008/0010787 | A1 * | 1/2008 | Kinskey | 24/298 |
| 2008/0235914 | A1 * | 10/2008 | Dolberg | 16/430 |

* cited by examiner

STRAP ATTACHMENT DEVICE

CROSS-REFERENCE TO RELATED APPLICATION

This application claims priority under 35 USC §119(e) to U.S. Provisional Patent Application 61/256,360 filed Oct. 30, 2009, the entirety of which is incorporated by reference herein.

FIELD OF THE INVENTION

This document concerns an invention relating generally to a strap attachment device, and more specifically to a portable strap attachment device well suited for sports, athletic training, exercise, and physical rehabilitation activities.

BACKGROUND OF THE INVENTION

Straps are used in a variety of activities in which an object is to be tethered in relation to one or more other objects. One common category of activities that makes use of straps is fitness and exercise. None, one, or more of the tethered objects may be relatively stationary, while remaining objects may be relatively free to move. For example, one end of a strap may be fixed to a wall, while the other end may be gripped by a user. One manner of forming a grip or handle at one end of a strap is to fold one end of the strap onto itself and attach the folded end onto a given point along the strap's length. A strap may also be hung on or looped around an object such as a metal bar. Such hanging or looping, however, does not generally anchor the strap's position around the object, so the length of the strap that extends from either side of the metal bar is not fixed.

A strap's usefulness may be enhanced by attaching the strap to a strap attachment device. A strap attachment device may, for example, grip one or more straps at a given position and lock onto the strap. U.S. Pat. No. 6,267,711 to Hinds incorporates a multi-part mechanism for attaching an elastic cord to a bar, but the mechanism has: (i) a high part count; (ii) an inability to adjust and lock the position of the cord along the mechanism; and (iii) a large distance between the cord and the bar, limiting the range of motion. U.S. Pat. No. 6,941,620 to Hinds describes a pair of cam buckles capable of attaching to two straps, but the cam buckles do not themselves attach to other objects.

Conventional strap attachment devices with high part counts tend to be costly and difficult to use. Additionally, strap attachment devices that do not minimize the distance between the strap and an object to be linked with the strap limit the range of motion achievable for activities such as exercise. What is needed is a strap attachment device that limits part count and provides an easy-to-use interface, and that positions a strap closer to objects in order to achieve a greater range of motion.

SUMMARY OF THE INVENTION

The invention involves a fitness device which is intended to at least partially solve the aforementioned problems. To give the reader a basic understanding of some of the advantageous features of the invention, following is a brief summary of preferred versions of the strap attachment device, with reference being made to the accompanying drawings (which are briefly reviewed in the following "Brief Description of the Drawings" section of this document) to assist the reader's understanding. Because the following discussion is merely a summary, it should be understood that more details regarding the preferred versions may be found in the Detailed Description set forth elsewhere in this document. The claims set forth at the end of this document then define the various versions of the invention in which exclusive rights are secured.

Referring initially to FIG. 1, an exemplary version of a cam hook device includes a main body 100 with a lower body end 102 and an opposing upper body end 104. The lower body end 102 includes an opening 106, opposing sides 108*a* and 108*b*, and a base 110 located below the opening 106. As can be seen in FIG. 3, the base 110 may include a face 112 that is preferably irregular or rough to facilitate gripping of an opposing surface. The opening 106 is preferably rectangular, and is situated between the opposing sides 108*a* and 108*b*, the upper body end 104, and the irregular face 112 of the base 110. The opposing sides 108*a* and 108*b* of the lower body end 102 preferably include two opposing lower holes 114*a* and 114*b* and two opposing upper holes 116*a* and 116*b*.

Referring again to FIG. 1, the upper body end 104 of the main body 100 is curved, having a concave side 118 and an opposing convex side 120. The curved upper body end 104 preferably forms a hook 122. The concave side 118 and/or the convex side 120 of the hook 122 may optionally be ridged to enhance strength, to facilitate gripping, and/or for aesthetic reasons, or they may be smooth. As shown in FIGS. 2 and 4, the concave side 118 of the hook 122 optionally includes one or more slip-resistant portions 124*a* and 124*b* for ease of use.

Returning to FIG. 1, a cam lever 126 is located at the opening 106 of the lower body end 102. FIGS. 3 and 4 show that cam lever 126 includes a lower face 128 and an opposing handle 130, with a bearing 132 located therebetween. The lower face 128 of the cam lever 126 preferably has an irregular surface (such as a toothed, ridged, or bumpy surface) to enhance gripping of a strap. Bearing 132 is preferably cylindrical, although other shapes may be used as well.

FIGS. 2 and 4 include a first pin 134 that is received in the cylindrical bearing 132 and through the lower holes 114*a* and 114*b* of the opposing sides 108*a* and 108*b* of the opening 106. The cam lever 126 is rotatable on the first pin 134, such that the handle 130 of the cam lever 126 could cover the rectangular opening 106 of the lower body end 102 to varying degrees as the cam lever 126 rotates.

Referring to FIG. 4, the length of the cylindrical bearing 132 is interrupted by a bearing gap 136 located between opposing ends of the cylindrical bearing 132. A spring 138 fits within the bearing gap 136, spring-loading the cam lever 126 with respect to main body 100. The spring 138 includes a central hole 140, with the first pin 134 being inserted through the central hole 140 of the spring 138.

Referring to FIG. 3, the cam hook device preferably includes gate 144 (to enhance safety and stability) and a fixed end 146. The fixed end 146 attaches to the main body 100, and is oriented such that the gate 144 protrudes from the lower body end 102 toward the upper body end 104. The gate 144, which is preferably flexible, helps prevent the cam hook device from separating from an object on which the upper body end 104 is hooked.

The fixed end 146 of the gate 144 preferably has two opposing lower holes 148*a* and 148*b* and two opposing upper holes 150*a* and 150*b*. To attach the fixed end 146 of the gate 144 to the lower body end 102, the first pin 134 is inserted through the two opposing lower holes 148*a* and 148*b* of the fixed end 146. A second pin 152 is preferably inserted through the two opposing upper holes 116*a* and 116*b* of the opposing sides 108*a* and 108*b* of the lower body end 102 and the two opposing upper holes 150*a* and 150*b* of the fixed end 146.

Referring to FIG. 5, a strap 200 may be inserted through the opening 106 of the lower body end 102. The strap 200 is held at a particular position within the opening 106 by being pressed between the cam lever 126 and the lower body end 102. Specifically, the strap 200 is preferably engaged between the irregular lower face 128 of the cam lever 126 and the irregular face 112 of the lower body end 102. The strap 200 could then be released from the lower body end 102 by distancing the cam lever 126 from the lower body end 102, as by rotating the cam lever 126 on the first pin 134.

The strap 200 has a first end 202 and a second end 204. The first end 202 of the strap 200 could optionally have a loop or a handle, and the second end 204 could optionally be attached to such items as a handle, a cuff, or an elastic cable.

Such a design offers many advantages. For example, combining the hook 122 of the upper body end 104 with the cam lever 126 and adjustable strap 200 of the lower body end 102 into one device reduces part count, reducing cost and improving usability. Integrating hook 122 and cam lever 126 in one device also positions the strap 200 closer to the object on which the upper body end 104 hooks, allowing a greater range of motion during exercises.

Further advantages and features of the invention will be apparent from the remainder of this document in conjunction with the associated drawings.

DETAILED DESCRIPTION OF PREFERRED VERSIONS OF THE INVENTION

It should be understood that various terms referring to orientation and position are used throughout this document—e.g., "upper" (as in "upper body end" or "upper hole"), "below" (as in "below the opening"), and "toward" (as in "toward the upper body end")—and that such terms are relative rather than absolute. Such terms should be regarded as words of convenience, rather than limiting terms.

Figure 1:
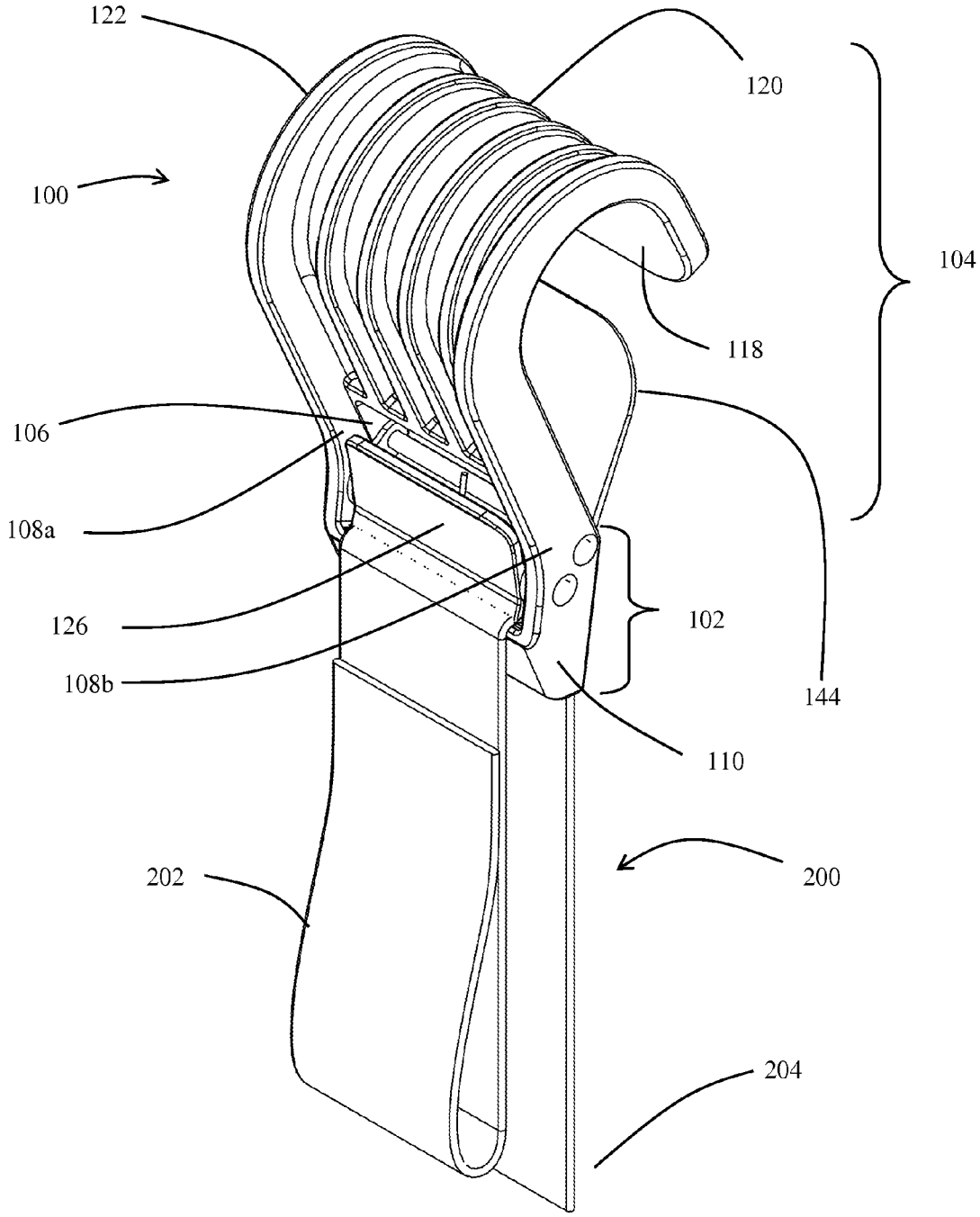
FIG. 1 is a diagram showing a top-front perspective view of an exemplary version of a cam hook device.

Continuing the discussion in the above Summary of the Invention section, FIG. 1 depicts an exemplary cam hook device that includes lower body end 102 and upper body end 104 extending upwards therefrom. The lower body end 102 and the upper body end 104 may be separately manufactured and affixed together to form the main body 100, or the main body 100 can be manufactured as a one structure. Moreover, the lower body end 102 may be constructed using a different material than the upper body end 104. One end may be constructed using, for example, a plastic or composite, while the other end may be constructed using, for example, a metal or metal alloy. The curved upper body end 104 preferably forms a hook 122 but need not be limited to a hook shape. For example, the upper body end 104 may form a loop or any other shape suited to connecting the upper body end 104 to another object. The upper body end 104 may be hinged with the lower body end 102. Additionally, the upper body end 104 may be retractable within the lower body end 102, or the lower body end 102 may be retractable within the upper body end 104, with an optional release button allowing the retracted end to advance.

From the side of the lower body end 102 opposite the side with the cam lever 126, the gate 144 is shown protruding upward toward the hook 122. Alternatively, the gate 144 may protrude from the upper body end 104 (such as from the tip of hook 122), extending toward the lower body end 102. Moreover, the gate 144 may include a flexible portion extending from the upper body end 104 and a flexible portion extending from the lower body end 102, the flexible portions meeting somewhere in between. The gate 144 is preferably flexible, such that it may flex enough to move out of the way, permitting the hook 122 to snap over an object like a bar. Once the main body 100 is hooked on the object, the gate 144 helps keep the main body 100 from becoming unhooked prematurely. To give the gate 144 flexibility, the gate 144 is preferentially made using a less rigid material than used to make the hook 122 of the upper body end 104. The gate 144 may be constructed using, for example, polypropylene. By contrast, the hook 122 may be made from a very strong, stiff plastic, such as a glass-filled nylon. It is noted any suitable material may be used in any of the parts.

The gate 144 may alternatively include any structure that allows the hook 122 to slide over an object like a bar but is able to keep the object together with the hook 122. The gate 144 may be translatable, able to move out of the way in order to allow the hook 122 to slide over an object like a bar, and move back into place to keep the object together with the hook 122. For example, or a spring-loaded pin/bar able to retract into the main body 100 to provide passage for the object, and advance to secure the object to the main body 100. The gate may also be hinged, providing flexibility at a point of attachment with the main body 100 but able to secure the object with the main body 100 when engaged.

Figure 2:
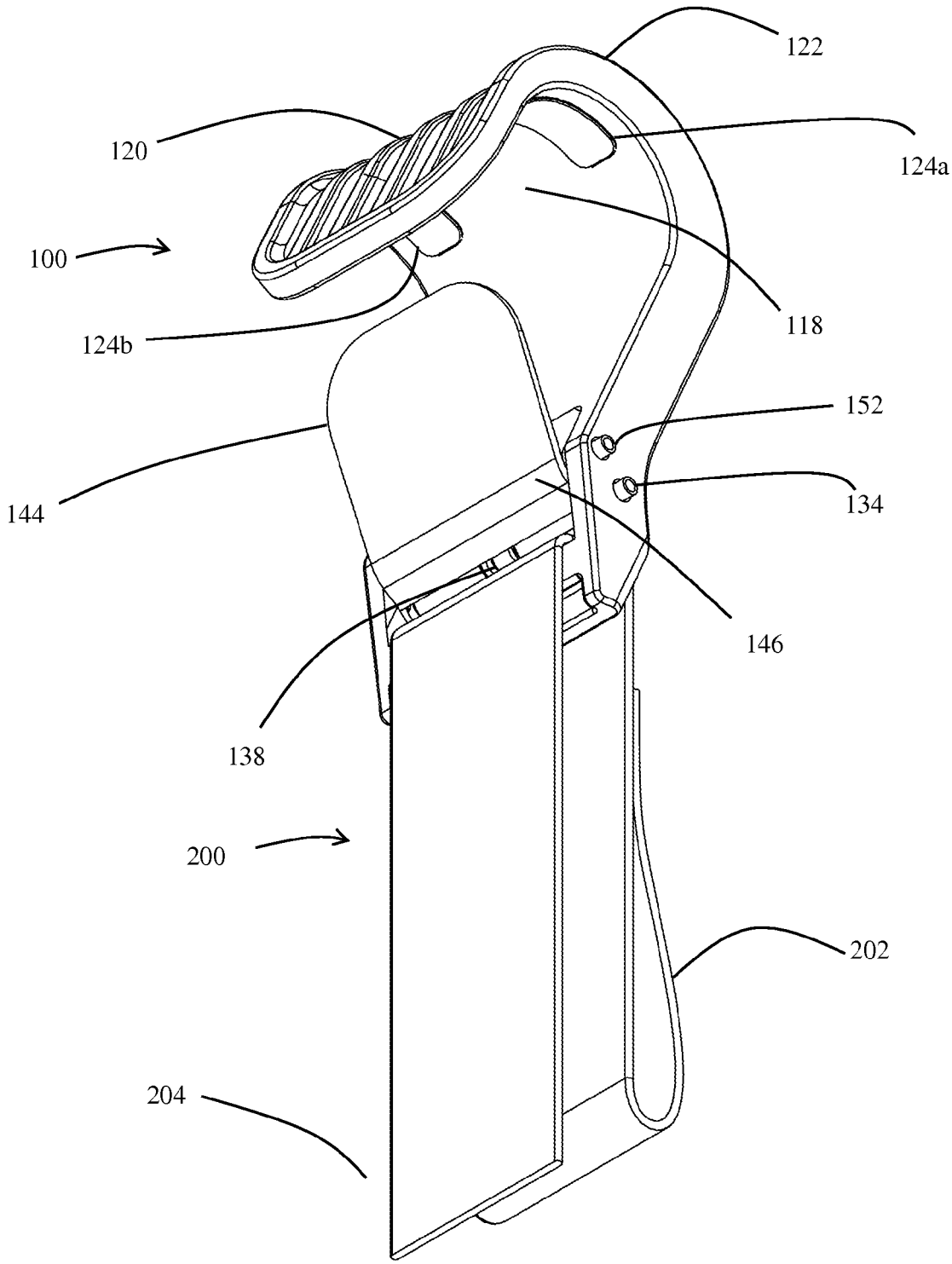
FIG. 2 is a diagram showing a bottom-rear perspective view of the cam hook device of FIG. 1.

FIG. 2 depicts the exemplary cam hook device from an alternative perspective. The concave side 118 of the hook 122 optionally includes soft elastomer slip-resistant portions 124*a* and 124*b*. The slip-resistant portions 124*a* and 124*b* resist side-to-side slipping of the cam hook device while it is hooked on an object such as a pull-up bar or a door. Slip resistance may, alternatively, be accomplished through other means. For example, the surface of the concave side 118 of the hook 122 may be roughened or made irregular to limit its slippage along an object. Alternatively or additionally, one or more slip-resistant portions may include a slip-resistant sleeve, band, cuff, etc., provided over a segment of the main body 100, such as the upper body end 104, or all of the main body 100.

In this perspective view, the gate 144 is shown including fixed end 146. The gate 144 may attach to the main body 100 using a first pin 134 and a second pin 152. The gate 144 need not, however, attach to the lower body end 102 of the main body 100 using pins. The fixed end 146 may instead be attached, for example, by welding it to the lower body end 102.

Figure 3:
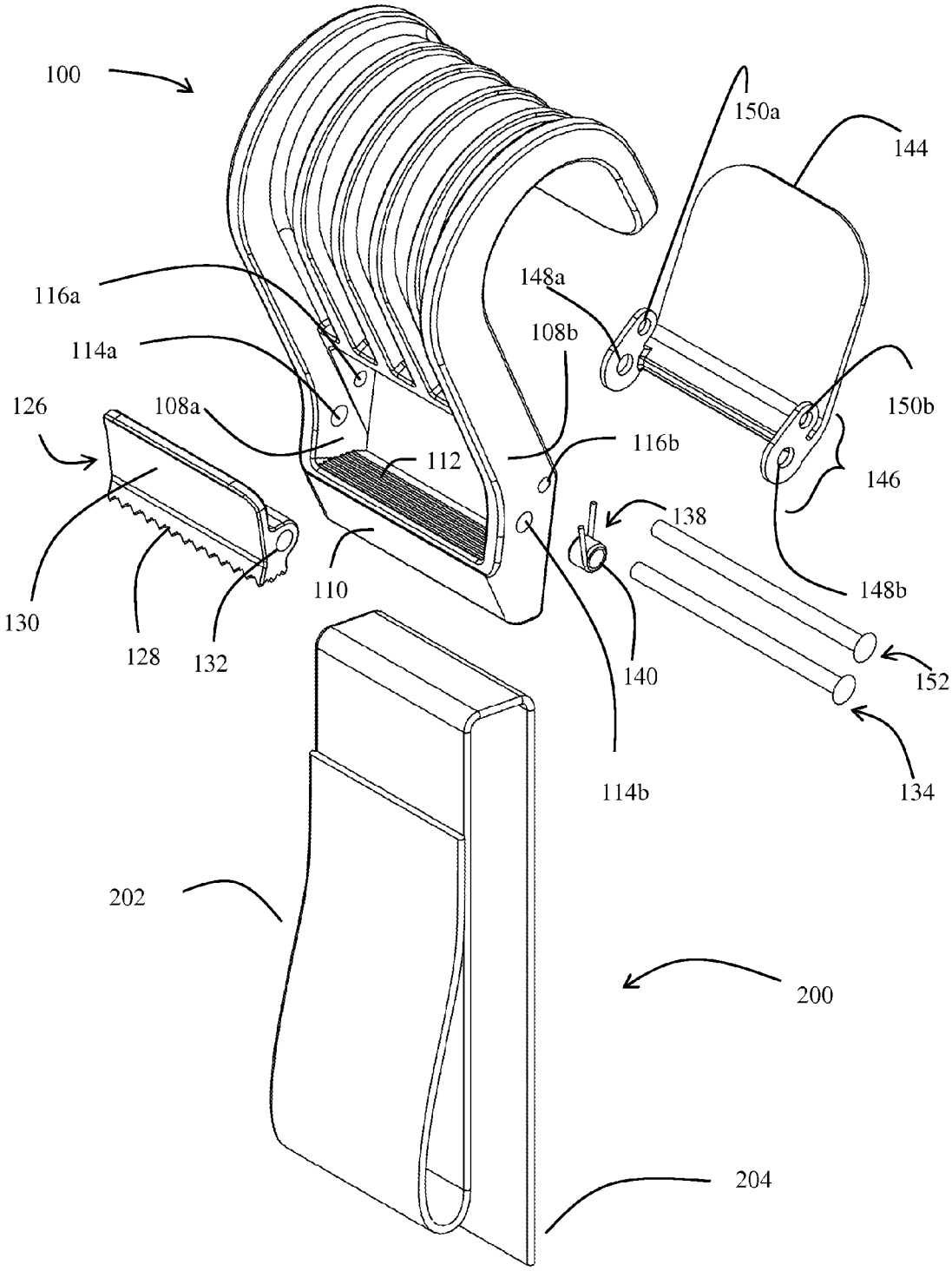
FIG. 3 is a diagram showing a top-front perspective view of the cam hook device of FIGS. 1 and 2, shown in disassembled state.

FIG. 3 depicts the disassembled components of the exemplary version of the cam hook device. The opening 106 is shown to be rectangular, defined by opposing sides 108*a* and 108*b*, the upper body end 104 (not labeled), and the irregular face 112 of the base 110. Opening 106 is not, however, limited to a rectangular shape, and it could be, for example, another multi-sided shape, oval, or circular.

In assembling the exemplary cam hook device, first pin 134 is inserted through the two lower holes 114*a* and 114*b* of the opposing sides 108*a* and 108*b*, the two opposing lower holes

148*a* and 148*b* of the fixed end 146, central hole 140 of spring 138, and bearing 132 of cam lever 126. Second pin 152 is preferably inserted through the two upper holes 116*a* and 116*b* of the opposing sides 108*a* and 108*b*, and the two opposing upper holes 150*a* and 150*b* of fixed end 146. The use of two pins in fixed end 146 fixes the gate 144 to main body 100, whereas the use of one pin through cam lever 126 permits the cam lever 126 to rotate. It is noted that the spring 138 may be a torsion spring, a compression spring, a spring arm, an elastic member (such as a rubber bumper), or any other member applying a biasing force.

Figure 4:
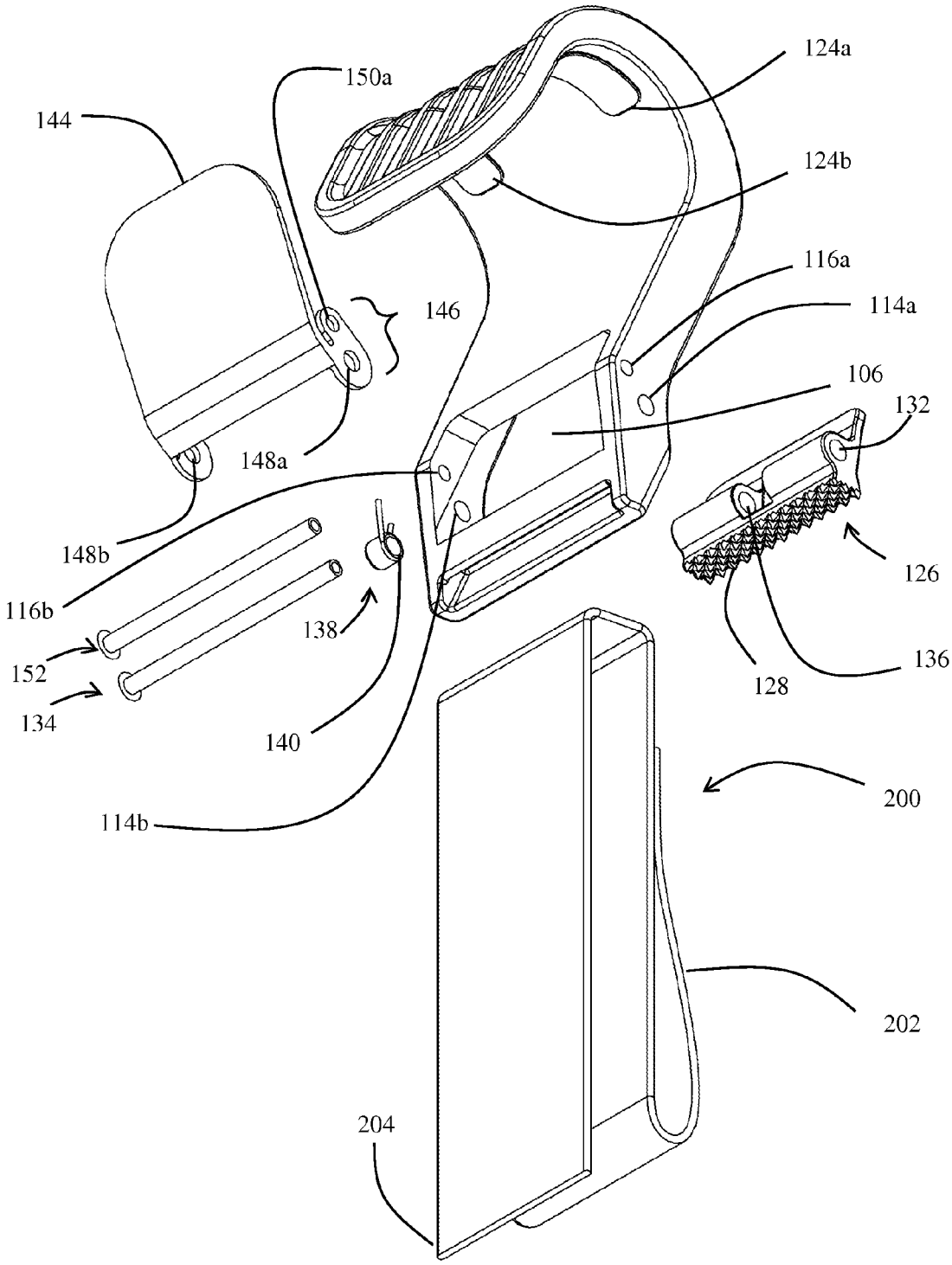
FIG. 4 is a diagram showing a bottom-rear perspective view of the disassembled cam hook device of FIG. 3.

FIG. 4 depicts an alternate view of the disassembled exemplary cam hook device. Features not viewable in the disassembled cam hook device of FIG. 3 include the optional slip-resistant portions 124*a* and 124*b* and bearing gap 136 of cam lever 126.

Figure 5:
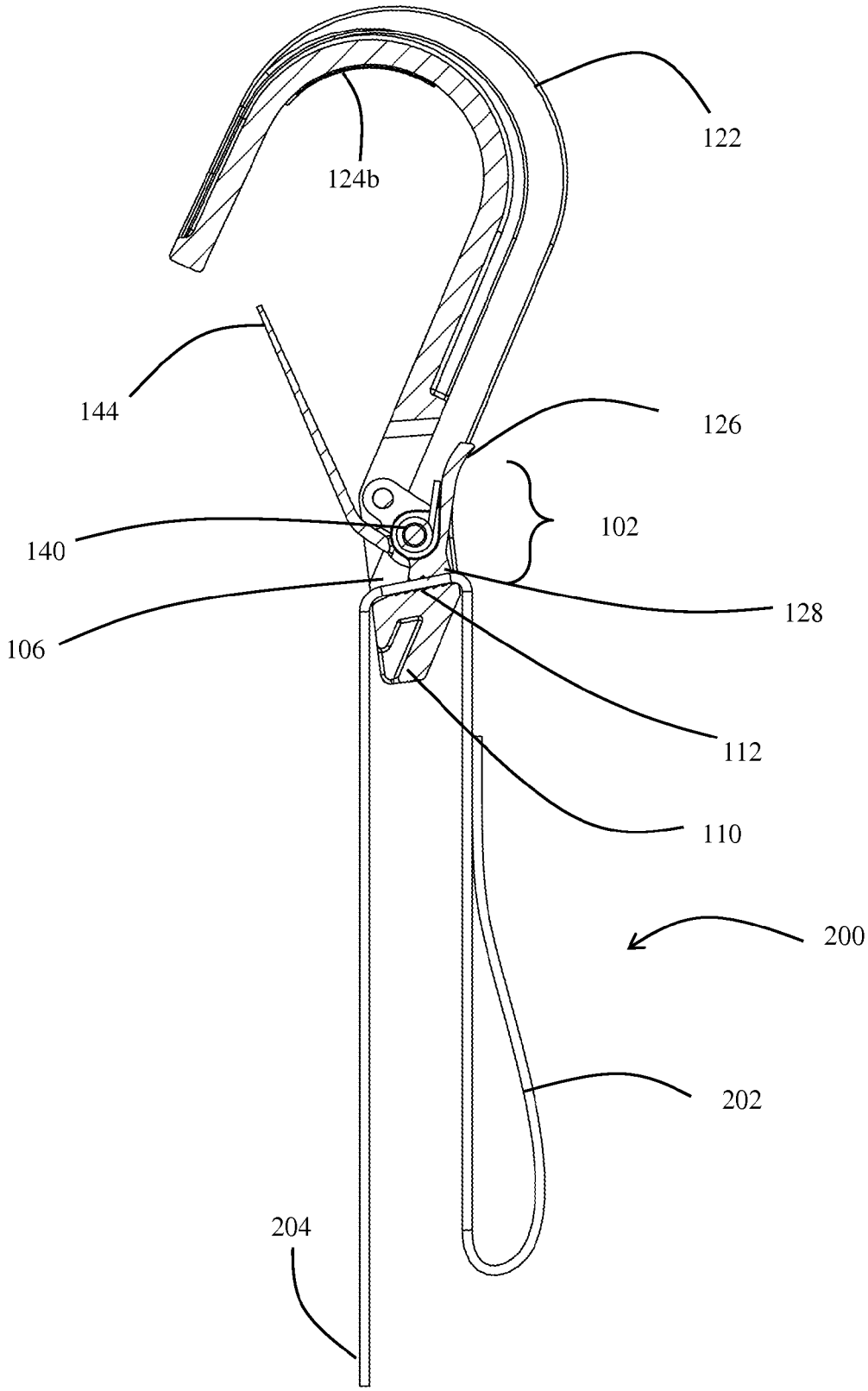
FIG. 5 is a diagram showing a cut-away side view of the cam hook device of FIGS. 1 and 2.

FIG. 5 depicts a side cut-away view of the exemplary cam hook device. Here, cam lever 126 has been rotated into a closed position, engaging strap 200 between the lower face 128 of cam lever 126 and irregular face 112 of base 110. In this position, the strap 200 is "locked" and cannot further thread opening 106 of the lower body end 102. To release strap 200, cam lever 126 can be rotated along an axis that is perpendicular with the page (not depicted), distancing lower face 128 from face 112.

Cam lever 126 thus permits strap 200 to be adjusted, such that a length of the strap 200 that is inserted through the opening 106 can be altered as desired by a user. A user may, for example, pull on the first end 202 of strap 200 to aid adjustment of the length of the strap 200 that is inserted through opening 106 at lower body end 102.

Preferred versions of the invention have been described above in order to illustrate how to make and use the invention. The invention is not intended to be limited to these versions, but rather is intended to be limited only by the claims set out below. Thus, the invention encompasses all different versions that fall literally or equivalently within the scope of these claims.

What is claimed is:

1. A cam hook device, including:

a) a main body, including:

1) a lower body end, including:

(i) a rectangular opening between opposing sides, wherein each of the opposing sides includes a lower hole and an upper hole; and (ii) a base including a face, wherein the base is situated below the rectangular opening;

2) an upper body end extending from the lower body end, the upper body end including a curved hook portion having a concave side and an opposing convex side;

b) a cam lever situated at the rectangular opening of the lower body end, the cam lever including:

1) an irregular lower face;

2) a handle opposite the lower face; and 3) a cylindrical bearing situated between the lower face and the handle, wherein the cylindrical bearing is interrupted by a bearing gap situated between opposing ends of the cylindrical bearing;

4) wherein:

(i) a first pin is received within the cylindrical bearing and through the lower holes of the opposing sides of the rectangular opening, and (ii) the cam lever is rotatable on the first pin, such that the handle of the cam lever covers the rectangular opening of the lower body end to varying degrees as the cam lever rotates;

c) a torsion spring spring-loading the cam lever, the spring including a central hole, wherein:

1) the spring is situated in the bearing gap, and 2) the first pin is inserted through the central hole of the spring;

d) a gate extending from the lower body end toward the upper body end, the gate including a fixed end having two opposing lower holes and two opposing upper holes, wherein:

1) the first pin is inserted through the two opposing lower holes, and 2) a second pin is inserted through the two opposing upper holes and the two upper holes of the opposing sides of the lower body end; and e) a strap inserted through the rectangular opening of the lower body end, wherein:

1) the strap is held in place by being pressed between the toothed face of the cam lever and the irregular face of the base of the lower body end, and 2) the strap is released from the base of the main body by rotating the cam lever on the lateral axis.

2. The cam hook device of claim 1, wherein the strap further includes:

a) a first end having a loop or a handle; and b) a second end, wherein the second end attaches to a fitness product selected from a group including a handle, a cuff, and an elastic cable.

* * * * *